US007563735B2

(12) United States Patent
Shimazaki et al.

(10) Patent No.: US 7,563,735 B2
(45) Date of Patent: Jul. 21, 2009

(54) WEBBING FOR A SEAT BELT

(75) Inventors: Sadayuki Shimazaki, Tokyo (JP); Itsuo Tabayashi, Tokyo (JP)

(73) Assignee: Takata Corporation, Tokyo (JP)

( * ) Notice: Subject to any disclaimer, the term of this patent is extended or adjusted under 35 U.S.C. 154(b) by 274 days.

(21) Appl. No.: 11/601,727

(22) Filed: Nov. 20, 2006

(65) Prior Publication Data

US 2007/0123126 A1 May 31, 2007

(30) Foreign Application Priority Data

Nov. 28, 2005 (JP) ..... 2005-342919

(51) Int. Cl.
*D03D 13/00* (2006.01)

(52) U.S. Cl. ..... 442/203; 139/383 R; 280/805; 442/189

(58) Field of Classification Search ..... 139/383 R; 280/805; 442/189, 190, 191, 192, 195, 196, 442/197, 201, 202, 217, 220
See application file for complete search history.

(56) References Cited

U.S. PATENT DOCUMENTS

| | | | | |
|---|---|---|---|---|
| 5,298,321 | A * | 3/1994 | Isoda et al. | 442/359 |
| 5,713,601 | A | 2/1998 | Bönigk | |
| 2006/0005913 | A1 | 1/2006 | Berger | |
| 2006/0016546 | A1 | 1/2006 | Berger | |

FOREIGN PATENT DOCUMENTS

| | | |
|---|---|---|
| EP | 0 717 133 A2 | 6/1996 |
| JP | 2-46881 | 3/1990 |
| JP | 7-207582 | 8/1995 |
| JP | 7-309200 | 11/1995 |
| JP | 8-72668 | 3/1996 |
| JP | 8-188938 | 7/1996 |
| JP | 8-299161 | 11/1996 |
| JP | 9-31850 | 2/1997 |
| JP | 9-323619 | 12/1997 |
| JP | 10-121323 | 5/1998 |
| JP | 2000-248469 | 9/2000 |
| JP | 2001-234477 | 8/2001 |

(Continued)

OTHER PUBLICATIONS

European Search Report dated Apr. 2, 2009 (3 pgs.).

*Primary Examiner*—Arti Singh-Pandey
(74) *Attorney, Agent, or Firm*—Foley & Lardner LLP

(57) ABSTRACT

The disclosed webbing for a passenger restraint belt may include warp yarns and weft yarns made of synthetic filaments and woven so as to extend orthogonally to each other. At least one of the warp yarns and the weft yarns may be formed using synthetic filaments comprising first filaments and second filaments. Also, the second filaments may be provided in the first filaments and have a melting temperature lower than that of the first filaments. The synthetic filaments may be high shrinking synthetic filaments which are contracted at a dimensional shrinkage rate of 20% to 60% after the second filaments are melted under conditions of 150° C. or more for 180 seconds or more. The webbing may have a weight of 60g/m or less, a tensile strength of 25 kN or more, and a retention rate after hexagonal bar abrasion of 70% or more.

7 Claims, 3 Drawing Sheets

FOREIGN PATENT DOCUMENTS

| | | |
|---|---|---|
| JP | 2001-294122 | 10/2001 |
| JP | 2001-295153 | 10/2001 |
| JP | 2002-029372 | 1/2002 |
| JP | 2002-240680 | 8/2002 |
| JP | 2002-362304 | 12/2002 |
| JP | 2004-315984 | 11/2004 |
| WO | WO 00/20671 | 4/2000 |

* cited by examiner

FIG. 2

| | WEAVING CONDITIONS | | | | | WEBBING PROPERTIES | | | | OVERALL EVALUATION |
|---|---|---|---|---|---|---|---|---|---|---|
| | WARP | | WEFT | | | | | | | |
| | HIGH-MELTING-POINT POLYESTER [dtex/f] | NUMBER OF WARPS | HIGH-MELTING-POINT POLYESTER [dtex/f] | LOW-MELTING-POINT POLYESTER [dtex/f] | NUMBER OF WOVEN WEFTS (WEFTS PER INCH) | WEIGHT [g/m] | WEIGHT REDUCTION RATE [%] | TENSILE STRENGTH [kN] | 'RETENTION RATE' AFTER HEXAGONAL BAR ABRASION [%] | |
| EXAMPLE-1 | 1670/144 | 246 | 560/96 | 84/12 | 19 | 52.53 | 14.72 | 29.73 | 73.88 | ◎ |
| EXAMPLE-2 | 1670/144 | 246 | 560/96 | 84/12 | 20 | 53.47 | 13.20 | 28.47 | 87.59 | ◎ |
| EXAMPLE-3 | 1670/144 | 250 | 560/96 | 84/12 | 19 | 54.90 | 10.88 | 28.90 | 77.28 | ◎ |
| EXAMPLE-4 | 1670/144 | 250 | 560/96 | 84/12 | 20 | 56.00 | 9.09 | 28.43 | 82.18 | ◎ |
| EXAMPLE-5 | 1670/144 | 254 | 560/96 | 84/12 | 19 | 55.25 | 10.31 | 29.00 | 73.79 | ◎ |
| EXAMPLE-6 | 1670/144 | 254 | 560/96 | 84/12 | 20 | 56.05 | 9.01 | 28.27 | 87.50 | ◎ |
| EXAMPLE-7 | 1670/144 | 264 | 560/96 | 84/12 | 18 | 56.34 | 8.54 | 30.07 | 80.27 | ◎ |
| EXAMPLE-8 | 1670/144 | 264 | 560/96 | 84/12 | 19 | 57.35 | 6.90 | 29.07 | 83.94 | ◎ |
| EXAMPLE-9 | 1670/144 | 280 | 560/96 | 84/12 | 17 | 59.69 | 3.10 | 32.20 | 76.40 | ◎ |
| COMPARATIVE EXAMPLE | 1670/144 | 280 | 830/96 | NONE | 19 | 61.60 | STANDARD | 32.33 | 82.30 | × |

WEBBING FOR A SEAT BELT

BACKGROUND

The present invention relates to a technique for forming a passenger restraint belt used for restraining a passenger when a vehicle accident occurs.

A conventional technique for forming a passenger restraint belt has been described, for example, in Japanese Unexamined Patent Application Publication No. 2004-315984 (the '984 publication) (incorporated by reference herein). The '984 publication discloses the possibility of forming a seat belt having superior compactness and comfort for use as a long passenger restraint belt by improving filament yarn bundles used for the seat belt, the woven configuration of the bundles and the like.

When this type of seat belt is designed, a basic property of rigidity capable of restraining a passenger in the case of a vehicle accident is required. Also, a reduction in the weight of the seat belt is also desired in consideration of the comfort of the passenger when the seat belt is worn as disclosed in the above the '984 publication and the properties of withdrawing the seat belt from a retractor. In order to reduce the weight of the seat belt, it is conceived that the number of filaments forming the seat belt may be reduced. By a method for simply reducing the number of filaments, the reduction in weight may be achieved; however, the decrease in rigidity caused by the reduction in the number of filaments may become a concern. As a result, the basic property of restraining a passenger may not be sufficiently obtained in some cases.

An object of a disclosed exemplary embodiment is to provide an effective technique for simultaneously achieving the increase in rigidity of a passenger restraint belt which is installed in a vehicle and the reduction in weight of the restraint belt. The disclosed exemplary embodiments may be applied to a technique for forming a seat belt or a safety belt, which is used as a means for restraining a passenger in a vehicle such as an automobile.

SUMMARY

A first disclosed exemplary embodiment is a webbing for a passenger restraint belt, such as a long seat belt which is retracted or withdrawn by a seat belt retractor or a safety belt of an air plane. The webbing for the passenger restraint belt may be formed as a webbing in which vertical yarns (also called "warp yarns") and horizontal yarns (also called "weft yarns"), both of which are made of synthetic filaments, are woven to extend orthogonally to each other.

In particular, in the webbing for the passenger restraint belt, at least either one of the weft yarns and the warp yarns are formed using synthetic filaments composed of first filaments and second filaments. The second filaments are provided in the first filaments and have a melting temperature lower than that of the first filaments. The synthetic filaments are high shrinking synthetic filaments which are contracted at a dimensional shrinkage rate of 20% to 60% after the second filaments are melted under conditions of 150° C. or more for 180 seconds or more. The state in which the second filaments are provided in the first filaments includes the state in which the second filaments are substantially evenly dispersed between the first filaments or the state in which the second filaments are unevenly scattered in the first filaments. The high shrinking synthetic filaments are called "high shrinking type synthetic filaments" or "high shrinking yarns." In addition, cases may be included in which the warp yarns or the weft yarns are formed using the high shrinking synthetic filaments and in which the warp yarns and the weft yarns are both formed using the high shrinking synthetic filaments. In such cases, the warp yarns and/or the weft yarns may be partly or entirely formed using high shrinking synthetic filaments. Polyester-based filaments, in particular, may be used as the high shrinking synthetic filaments. The dimensional shrinkage rate of the filaments, such as the warp yarns and the weft yarns (i.e., the degree of shrinkage in the longitudinal direction) may be represented by the following equation: ((length after process—length before process])/length after process)× 100. The lengths are obtained before and after the process performed under the above process conditions. The dimensional shrinkage rate may be obtained using a process method or a measurement method in accordance with, for example, JIS L 1909.

In the webbing for a passenger restraint belt, when at least either one of the warp yarns and the weft yarns are formed using high shrinking synthetic filaments having a dimensional shrinkage rate of 20% to 60%, and when the webbing is heated in accordance with the above process conditions, the second filaments having a low melting point of the high shrinking synthetic filaments are preferentially melted, and shrinkage and convergence of the warp yarns and/or the weft yarns occur in the longitudinal direction. As a result, the cross-sectional area of the filament yarn material of the warp yarns and/or the weft yarns after the shrinkage is increased, and the hardness is increased so that the rigidity of the webbing is increased as a whole. Hence, corresponding to the increase in the rigidity of the webbing formed using yarns containing high shrinking synthetic filaments, the weight may be decreased by reducing the number of the warp yarns and/or the weft yarns. Consequently, a webbing for a passenger restraint belt having a weight of 60 g/m or less, a tensile strength of 25 kN or more, and a retention rate after hexagonal bar abrasion of 70% or more may be obtained so that a passenger restraint belt having both rigidity and lightweight properties may be provided. The tensile strength of the webbing may be measured by a method in accordance with the JIS L1096 8. 12. 1A method while the retention rate after hexagonal bar abrasion of the webbing may be measured by a method in accordance with the JIS D4604 method.

A second disclosed exemplary embodiment is a webbing for a passenger restraint belt, which has the structure in which the weft density is set to 20 picks per inch or less.

In a cross-sectional structure of this type of webbing, the warp yarns are extended to form a curved shape, a so-called "crimping (undulating phenomenon)," in contrast to the weft yarns which are linearly extended. This undulating phenomenon is caused by a weaving method forming a woven structure in which the weft yarns are woven between warp yarns which are shed alternately. When the weft density is set to 20 picks per inch or less and preferably set to 17 picks per inch or less, the degree of meanderings of the curved crimped shape may be decreased, and stress concentrated on curved portions may be alleviated. As a result, the properties for simultaneously achieving the increase in rigidity of webbing and the reduction in weight thereof may be further improved.

A third disclosed exemplary embodiment is a webbing for a passenger restraint belt wherein at least either one of the warp yarns and the weft yarns are formed using a filament yarn material made of twist yarns or a filament yarn material made of entangled non-twist yarns. This embodiment may include the case in which the warp yarns or the weft yarns are formed using a filament yarn material made of twist yarns or a filament yarn material made of entangled non-twist yarns and the case in which the warp yarns and the weft yarns are both formed using a filament yarn material made of twist yarns or a filament yarn material made of entangled non-twist yarns. By using the filament yarn material as described above, because the entanglement among the filaments is increased and the cohesion is enhanced, the rigidity of the webbing may be further improved. When the filament yarn material made of entangled non-twist yarns is used, the material costs may be reduced as compared to the case in which the filament yarn material made of twist yarns is used. As a result, a production cost of the webbing for a passenger restraint belt may also be reduced.

A fourth disclosed exemplary embodiment is a seat belt formed using the webbing for a passenger restraint belt according to one of the first through third embodiments. According to the structure as described above, the increase in rigidity of the seat belt and the reduction in weight thereof may be achieved at the same time.

A fifth disclosed exemplary embodiment is a seat belt device comprising at least the seat belt according to the fourth embodiment, a seat belt retractor, a buckle, and a tongue. The seat belt retractor may have a function of retracting and withdrawing the seat belt and may have a spool which is received in a retractor housing. The seat belt retractor may have a drive mechanism to drive the spool and a control mechanism to control the drive mechanism. In addition, the tongue provided for the seat belt may be configured to be engaged with the buckle fixed to a vehicle when the seat belt is worn. According to the structure described above, a seat belt device may be provided in which the increase in rigidity of the seat belt and the reduction in weight thereof are achieved at the same time.

In the webbing for a passenger restraint belt in which the warp yarns and the weft yarns, both of which are made of synthetic filaments, are woven so as to extend orthogonally to each other, at least either one of the warp yarns and the weft yarns are formed using high shrinking synthetic filaments so that a technique effective for simultaneously obtaining the increase in rigidity of a passenger restraint belt and the reduction in weight thereof may be provided.

It is to be understood that both the foregoing general description and the following detailed descriptions are exemplary and explanatory only, and are not restrictive of the invention as claimed.

BRIEF DESCRIPTION OF THE DRAWINGS

These and other features, aspects and advantages of the present invention will become apparent from the following description, appended claims, and the accompanying exemplary embodiments shown in the drawings, which are briefly described below.

FIG. 2 is a table showing the weaving conditions and the properties of the webbings for the seat belt 110 shown in FIG. 1 in which the webbings of various disclosed exemplary embodiments (example-1 to example-9) and a comparative example are shown.

DETAILED DESCRIPTION

Hereinafter, exemplary embodiments will be described in detail with reference to the figures.

One embodiment relates to a seat belt device installed in an automobile and proposes an optimum seat belt forming the seat belt device and a manufacturing method of the seat belt.

First, the structure of a seat belt device 100 will be described with reference to FIG. 1, which shows a schematic structure of the seat belt device 100.

Figure 1:
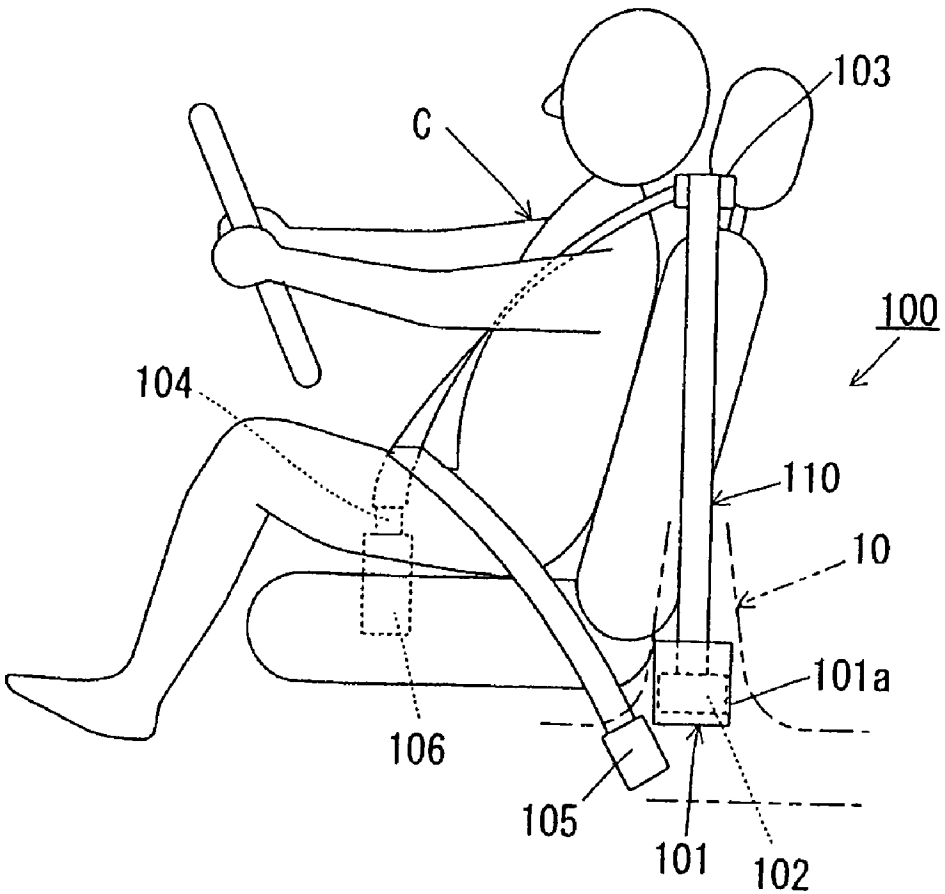
FIG. 1 is a schematic view of a seat belt device 100 according to an embodiment of the present invention.

As shown in FIG. 1, the seat belt device 100 may be a seat belt device for a vehicle, which is installed in a vehicle. The seat belt device 100 may be primarily composed, for example, of a seat belt retractor 101, a seat belt 110, a tongue 104, and a buckle 106.

The seat belt retractor 101 may have a structure in which at least a tubular spool 102 is received in a retractor housing 101*a* for retracting and withdrawing of the seat belt 110. The spool 102 is driven by a driving mechanism formed using a spring, a motor, or the like. According to the example shown in FIG. 1, the seat belt retractor 101 is arranged in an accommodation space of a B-pillar 10 of the vehicle.

The seat belt 110 may be a long belt to restraint a vehicle passenger C, and is a belt formed from a long belt-shaped member (i.e., a webbing) made of a synthetic filament yarn material. The seat belt 110 may be withdrawn from the seat belt retractor 101 which is fixed to the vehicle and is connected to an outer anchor 105 via a shoulder guide anchor 103 provided near a passenger shoulder part region of the vehicle passenger C and the tongue 104. In addition, when the tongue 104 is inserted into and engaged with the buckle 106 which is fixed to the vehicle, the seat belt 110 is in a seat belt wearing state for the vehicle passenger C.

In order to form a seat belt which is excellent for practical use, a webbing is woven for a seat belt in accordance with predetermined weaving conditions which will be described later, and webbing properties of the webbing for a seat belt are evaluated.

The weaving conditions of the webbing for the seat belt 110 shown in FIG. 1 and the webbing properties of various embodiments (example-1 to example-9) and a comparative example are shown in FIG. 2. The webbing for the seat belt for the various disclosed exemplary embodiments and that of the comparative example are each formed as a fabric in which warp yarns and weft yarns, both of which are formed from synthetic filaments, are woven so as to extend orthogonally to each other. In particular, in the embodiment of example-1 to example-9, high shrinking yarns which have a high shrinkage rate in the longitudinal direction of the filaments, are used as the weft yarns. In the comparative example, the high shrinking yarns are not used as the weft yarns.

As shown in FIG. 2, in "example-1," a filament yarn bundle of warp yarns each comprising 144 filaments having a dtex of 1670, which was a weight-reduced filament yarn bundle obtained by reducing 34 warp yarns from a normal product (in which the number of warp yarns was 280), was used as a first filament yarn bundle. By this reduction of warp yarns, the number of the warp yarns was decreased to 246. A yarn material made of entangled non-twist yarns was used as the first filament yarn bundle. In addition, weft yarns formed from high-melting-point polyester filaments each consisting of 96 filaments having a dtex of 560 and low-melting-point polyester filaments each consisting of 12 filaments having a dtex of 84, that is, high shrinking yarns having a thermal shrinkage rate of 30% under process conditions of 210° C. for 180 seconds, were used as a second filament yarn bundle. This shrinkage rate is the degree of shrinkage of the filaments in the longitudinal direction. A yarn which has a thermal shrinkage rate of 20% to 60% under process conditions of 150° C. or more for 180 seconds or more may be optionally selected as the high shrinking yarn.

As for blending the weft yarns between the high-melting-point polyester filaments and the low-melting-point polyester filaments, for example, one high-melting-point polyester filament consisting of 96 filaments having a dtex of 560 and four low-melting-point polyester filaments each consisting of 12 filaments having a dtex of 84 (regarded as a low-melting-point polyester filament consisting of 48 filaments having a dtex of 336) may be blended together. In such a case, a blending ratio between the high-melting-point polyester filaments and the low-melting-point polyester filaments is approximately set to 1.7. According to one embodiment, the blending ratio between the high-melting-point polyester filaments and the low-melting-point polyester filaments may be set, for example, from 1 to 2:1.

Typically, a polymer material of polyethylene terephthalate may be used as the high-melting-point polyester filaments forming the weft yarns. Polyethylene terephthalate is manufactured by an esterification reaction using terephthalic acid and ethylene glycol. Also, a copolymer material of polyethylene terephthalate and polyethylene isophthalate may be used as the low-melting-point polyester filaments forming the weft yarns. The copolymer is manufactured by an esterification reaction using terephthalic acid, isophthalic acid, and ethylene glycol.

Figure 3:
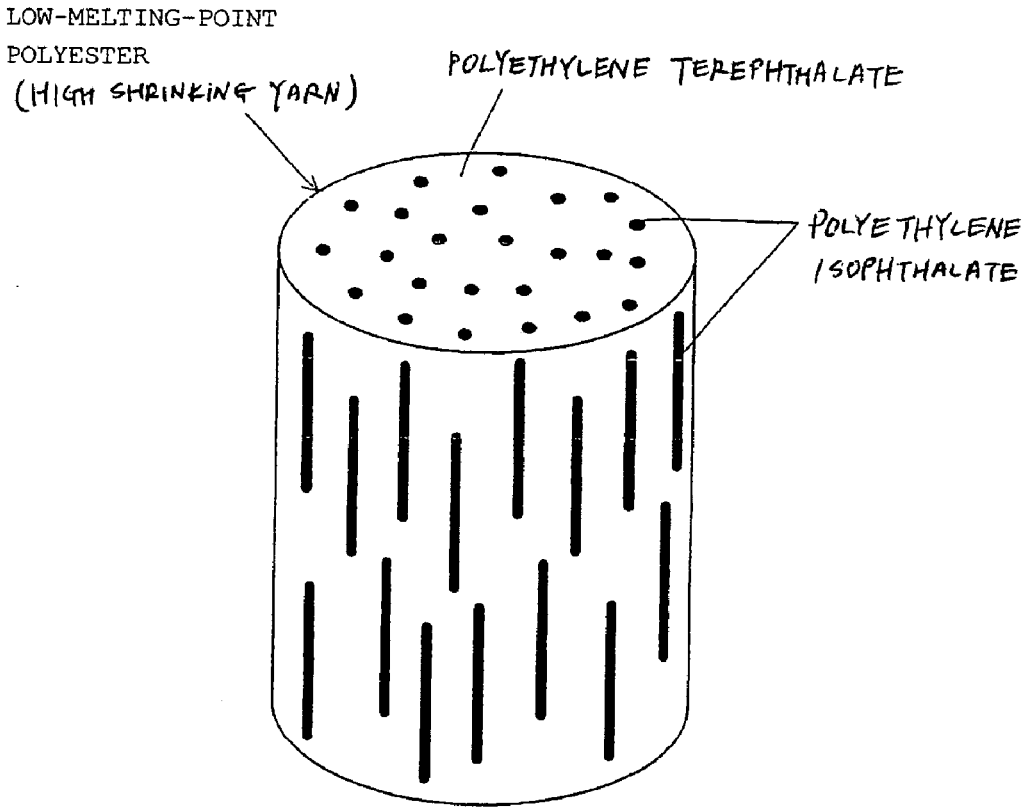
FIG. 3 is a schematic view showing a low-melting-point polyester filament (high shrinking yarn) according to an embodiment of the present invention.

A schematic view of the low-melting-point polyester filament (high shrinking yarn) according to one embodiment is shown in FIG. 3. As shown in FIG. 3, the low-melting-point polyester filament has a structure in which polyethylene isophthalate is dispersed in polyethylene terephthalate. That is, the low-melting-point polyester filament has a structure in the form of a copolymer in which polyethylene isophthalate having a low melting point is mixed in polyethylene terephthalate having a high melting point. A filament yarn material, which is a bundle composed of the low-melting-point polyester filaments (or monofilaments), is used as some of the weft yarns. This bundle is a so-called multifilament. When a webbing formed from the weft yarns as described above is heated, the polyethylene isophthalate (the low-melting-point filaments) having a low melting point relative to that of the polyethylene terephthalate is preferentially melted. The monofilaments are then melted together, and as a result, shrinkage and convergence occur. Hence, when multifilaments adjacent to each other form a monofilament by convergence, the hardness is increased. As a result, the cross-sectional area of a filament material after the shrinkage of the weft yarns is increased, and the hardness is increased so that the rigidity of the webbing is increased as a whole. The polyethylene terephthalate of this embodiment may correspond to the "first filaments" while the polyethylene isophthalate may correspond to the "second filaments having a melting point lower than that of the first filaments."

In the low-melting-point polyester filament, as a copolymerization ratio of polyethylene isophthalate (i.e., the amount thereof) is increased, the melting point of the filament yarn is decreased. For example, when the copolymerization ratio of polyethylene isophthalate is 10% (i.e., the ratio of polyethylene terephthalate is 90%), the melting point of the low-melting-point polyester filament is set to 230° C., and when the copolymerization ratio of polyethylene isophthalate is 30% (i.e., the ratio of polyethylene terephthalate is 70%), the melting point of the low-melting-point polyester filament is set to 160° C. In one embodiment, a low-melting-point polyester filament having a copolymerization ratio of polyethylene isophthalate of 10% and a melting point of 230° C. is used as the high shrinking yarn.

Next, the first filament yarn bundles and the second filament yarn bundles of example-1 were woven by a needle type loom in accordance with the weaving conditions shown in FIG. 2 so that a webbing for evaluation was obtained. In this weaving, the weft density was set to 19 picks per inch. Subsequently, after a dyeing process and a pre-drying process were performed on the webbing for evaluation whenever necessary, a heat stabilization process was performed. In the heat stabilization process, the webbing for evaluation was passed through a heating furnace at a controlled temperature of approximately 210° C. for approximately 180 seconds. The conditions for the heat stabilization process may be optionally selected from the range in which the temperature is 150° C. or more and the time is 180 seconds or more, for example, the process conditions of 150° C. for 300 seconds may be selected. Furthermore, when the webbing properties shown in FIG. 2 were measured, after the webbing for evaluation was cut into a test piece having a predetermined size, followed by spontaneous drying, the test piece was exposed under predetermined constant temperature and humidity conditions (20° C. and 65% RH).

In example-1, for example, by reducing the number of the warp yarns performed to obtain the first filament yarn bundle, the weight per unit length of the entire webbing for a seat belt was 52.53 g/m, and the weight reduction rate was 14.72%.

In "example-2," a filament yarn bundle of warp yarns each comprising 144 filaments having a dtex of 1670, which was a weight-reduced filament yarn bundle obtained by reducing 34 warp yarns from the normal product (in which the number of warp yarns was 280), was used as the first filament yarn bundle. By reducing the number of warp yarns, the number of the warp yarns was set to 246. A yarn material made of entangled non-twist yarns was used as the first filament yarn bundle. In addition, the second filament yarn bundle as that in example-1 was used as the second filament yarn bundle, and the weft density was set to 20 picks per inch. The other remaining conditions and the like were the same as those of example-1.

In example-2, for example, by reducing the number of warp yarns to obtain the first filament yarn bundle, the weight per unit length of the entire webbing for a seat belt was 53.47 g/m, and the weight reduction rate was 13.20%.

In "example-3," a filament yarn bundle of warp yarns each comprising 144 filaments having a dtex of 1670, which was a weight-reduced filament yarn bundle obtained by reducing 30 warp yarns from the normal product (in which the number of warp yarns was 280), was used as the first filament yarn bundle. By reducing the number of warp yarns, the number of warp yarns was set to 250. A yarn material made of entangled non-twist yarns was used as this first filament yarn bundle. In addition, the second filament yarn bundle as that in example-1 was used as the second filament yarn bundle. The other remaining conditions and the like were the same as those of example-1.

In example-3, for example, by reducing the number of warp yarns to obtain the first filament yarn bundle, the weight per unit length of the entire webbing for a seat belt was 54.90 g/m, and the weight reduction rate was 10.88%.

In "example-4," a filament yarn bundle of warp yarns each comprising 144 filaments having a dtex of 1670, which was a weight-reduced filament yarn bundle obtained by reducing 30 warp yarns from the normal product (in which the number of warp yarns was 280), was used as the first filament yarn bundle. By reducing the number of warp yarns, the number of warp yarns was set to 250. A yarn material made of entangled non-twist yarns was used as the first filament yarn bundle. In addition, the second filament yarn bundle as that in example-2 was used as the second filament yarn bundle. The other remaining conditions and the like were the same as those of example-2.

In example-4, for example, by reducing the number of warp yarns to obtain the first filament yarn bundle, the weight per unit length of the entire webbing for a seat belt was 56.00 g/m, and the weight reduction rate was 9.09%.

In "example-5," a filament yarn bundle of warp yarns each comprising 144 filaments having a dtex of 1670, which was a weight-reduced filament yarn bundle obtained by reducing 26 warp yarns from the normal product (in which the number of warp yarns was 280), was used as the first filament yarn bundle. By reducing the number of warp yarns, the number of warp yarns was set to 254. A yarn material made of entangled non-twist yarns was used as the first filament yarn bundle. In addition, the second filament yarn bundle as that in example-1 was used as the second filament yarn bundle. The other remaining conditions and the like were the same as those of example-1.

In example-5, for example, by reducing the number of warp yarns to obtain the first filament yarn bundle, the weight per unit length of the entire webbing for a seat belt was 55.25 g/m, and the weight reduction rate was 10.31%.

In "example-6," a filament yarn bundle of warp yarns each comprising 144 filaments having a dtex of 1670, which was a weight-reduced filament yarn bundle obtained by reducing 26 warp yarns from the normal product (in which the number of warp yarns was 280), was used as the first filament yarn bundle. By reducing the number of warp yarns, the number of the warp yarns was set to 254. A yarn material made of entangled non-twist yarns was used as the first filament yarn bundle. In addition, the second filament yarn bundle as that in example-2 was used as the second filament yarn bundle. The other remaining conditions and the like were the same as those of example-2.

In example-6, for example, by reducing the number of warp yarns to obtain the first filament yarn bundle, the weight per unit length of the entire webbing for a seat belt was 56.05 g/m, and the weight reduction rate was 9.01%.

In "example-7," a filament yarn bundle of warp yarns each comprising 144 filaments having a dtex of 1670, which was a weight-reduced filament yarn bundle obtained by reducing 16 warp yarns from the normal product (in which the number of warp yarns was 280), was used as the first filament yarn bundle. By reducing the number of warp yarns, the number of the warp yarns was set to 264. A yarn material made of entangled non-twist yarns was used as the first filament yarn bundle. In addition, the second filament yarn bundle as that in example-1 was used as the second filament yarn bundle, and the weft density was set to 18 picks per inch. The other remaining conditions and the like were the same as those of example-1.

In example-7, for example, by reducing the number of warp yarns to obtain the first filament yarn bundle and by reducing weft density to obtain the second filament yarn bundle, the weight per unit length of the entire webbing for a seat belt was 56.34 g/m, and the weight reduction rate was 8.54%.

In "example-8," a filament yarn bundle of warp yarns each comprising 144 filaments having a dtex of 1670, which was a weight-reduced filament yarn bundle obtained by reducing 16 warp yarns from the normal product (in which the number of warp yarns was 280), was used as the first filament yarn bundle. By reducing the number of warp yarns, the number of the warp yarns was set to 264. A yarn material made of entangled non-twist yarns was used as the first filament yarn bundle. In addition, the second filament yarn bundle as that in example-1 was used as the second filament yarn bundle. The other remaining conditions and the like were the same as those of example-1.

In example-8, for example, by reducing the number of warp yarns to obtain the first filament yarn bundle, the weight per unit length of the entire webbing for a seat belt was 57.35 g/m, and the weight reduction rate was 6.90%.

In "example-9," a filament yarn bundle of warp yarns each comprising 144 filaments having a dtex of 1670, in which the number of the warp yarns is normal (280 warp yarns), was used as the first filament yarn bundle. A yarn material made of entangled non-twist yarns was used as the first filament yarn bundle. In addition, the second filament yarn bundle as that in example-1 was used as the second filament yarn bundle, and the weft density was set to 17 picks per inch. The other remaining conditions and the like were the same as those of example-1.

In example-9, for example, by reducing the weft density to obtain the second filament yarn bundle, the weight per unit length of the entire webbing for a seat belt was 59.69 g/m, and the weight reduction rate was 3.10%.

In "the comparative example," a filament yarn bundle of warp yarns each consisting of 144 filaments having a dtex of 1670, in which the number of the warp yarns is normal (280 warp yarns), was used as the first filament yarn bundle. A yarn material made of entangled non-twist yarns was used as the first filament yarn bundle. In addition, a filament yarn bundle of weft yarns each consisting of 96 filaments having a dtex of 830 and containing no high shrinking yarns (which were used in example-1 to example-9) was used as the second filament yarn bundle. Also, the weft density for the second filament yarn bundle was set to 19 picks per inch.

In the comparative example, the weight per unit length of the entire webbing for a seat belt was 61.60 g/m, and the weight was defined as a weight-reduction standard.

For evaluation of the webbing properties, the parameters shown below were measured for the webbings for a seat belt of example-1 to example-9 and the comparative example wherein the webbings were formed in accordance with the weaving conditions described above. For every measurement parameter, at least 5 test pieces were prepared from each of the webbings, and the repeatability was confirmed from the measurement results.

For evaluation purposes, the "tensile strength" (also called the "intensity" or the "strength") and "retention rate after hexagonal bar abrasion" were used as the measurement parameters for evaluating the webbing properties of the webbing for the seat belt.

The tensile strength of the webbing was measured by a method in accordance with the JIS L1096 8. 12. 1A method. When the tensile strength of the webbing is designed so as to be 25 kN or more, the desired load bearing characteristics required for a seat belt may be obtained.

The retention rate after hexagonal bar abrasion of the webbing was measured by a method in accordance with the JIS D4604 method. When the webbing is designed to have the retention rate after hexagonal bar abrasion of, for example, 70% or more, the desired abrasion resistance required for a seat belt may be obtained.

Next, the webbings for a seat belt of example-1 through example-9 and the comparative example were evaluated based on the above measurement parameters. The terms "lightweight properties," "strength," "abrasion resistance," and the like were used as the evaluation items.

As shown in FIG. 2, the webbing of example-1 has a weight reduction rate of 14.72% relative to the comparative example due to the reduction of 34 warp yarns during the forming of the first filament yarn bundle. Hence, it is confirmed that the webbing of example-1 is exceptionally superior in terms of the lightweight properties. In addition, although the other evaluation parameters, i.e., the tensile strength and the hexagonal anti-abrasion resistance, are slightly inferior to those of the comparative example, both of them satisfy the respective predetermined levels, i.e., a tensile strength of 25 kN or more and a retention rate after hexagonal bar abrasion of 70% or more. Hence, it is confirmed that the strength and the abrasion resistance are also superior relative to the predetermined requirements for seat belt performance.

The webbing of example-2 has a weight reduction rate of 13.2% relative to the comparative example due to the reduction of 34 warp yarns during the forming of the first filament yarn bundle. Hence, it is confirmed that this webbing is superior in terms of the lightweight properties. In addition, although the tensile strength is slightly inferior to that of the comparative example, the webbing of example-2 satisfies the predetermined level, i.e., a tensile strength of 25 kN or more. Thus, it is confirmed that the strength of example-2 is also superior relative to the predetermined requirements for seat belt performance. Furthermore, because the retention rate after hexagonal bar abrasion is 87.59%, which is significantly larger than that of the comparative example, it is confirmed that the abrasion resistance of example-2 is exceptionally superior.

The webbing of example-3 has a weight reduction rate of 10.88% relative to the comparative example due to the reduction of 30 warp yarns during the forming of the first filament yarn bundle. Therefore, it is confirmed that the webbing of example-3 is superior in terms of the lightweight properties. In addition, although the other evaluation parameters, i.e., the tensile strength and the hexagonal anti-abrasion resistance, are slightly inferior to those of the comparative example, both of them satisfy the respective predetermined levels, i.e., a tensile strength of 25 kN or more and a retention rate after hexagonal bar abrasion of 70% or more. Thus, it is confirmed that the strength and the abrasion resistance of example-3 are also superior relative to the predetermined requirements for seat belt performance.

The webbing of example-4 has a weight reduction rate of 9.09% relative to the comparative example due to the reduction of 30 warp yarns during the forming of the first filament yarn bundle. Thus, it is confirmed that the webbing of example-4 is superior in terms of the lightweight properties. In addition, although the other evaluation parameters, i.e., the tensile strength and the hexagonal anti-abrasion resistance, are slightly inferior to those of the comparative example, both of them satisfy the respective predetermined levels, i.e., a tensile strength of 25 kN or more and a retention rate after hexagonal bar abrasion of 70% or more. Therefore, it is confirmed that the strength and the abrasion resistance of example-4 are also superior relative to the predetermined requirements for seat belt performance.

The webbing of example-5 has a weight reduction rate of 10.31% relative to the comparative example by the reduction of 26 warp yarns during the forming of the first filament yarn bundle. Thus, it is confirmed that the webbing of example-5 is superior in terms of the lightweight properties. In addition, although the other evaluation parameters, i.e., the tensile strength and the hexagonal anti-abrasion resistance, are slightly inferior to those of the comparative example, both of them satisfy the respective predetermined levels, i.e., a tensile strength of 25 kN or more and a retention rate after hexagonal bar abrasion of 70% or more. Therefore, it is confirmed that the strength and the abrasion resistance of example-5 are also superior relative to the predetermined requirements for seat belt performance.

The webbing of example-6 has a weight reduction rate of 9.01% relative to the comparative example due to the reduction of 26 warp yarns during the forming of the first filament yarn bundle. Thus, it is confirmed that the webbing of example-6 is superior in terms of the lightweight properties. In addition, although the tensile strength is slightly inferior to that of the comparative example, the tensile strength of example-6 satisfies the predetermined level, i.e., a tensile strength of 25 kN or more. Hence, it is confirmed that the strength of example-6 is also superior relative to the predetermined requirements for seat belt performance. Furthermore, because the retention rate after hexagonal bar abrasion is 87.50%, which is significantly larger than that of the comparative example, it is confirmed that the abrasion resistance of example-6 is exceptionally superior.

The webbing of example-7 has a weight reduction rate of 8.54% relative to the comparative example due to the reduction of 16 warp yarns during the forming of the first filament yarn bundle and due to the reduction in weft density (18 picks per inch) during the forming of the second filament yarn bundle. Hence, it is confirmed that the webbing of example-7 is superior in terms of the lightweight properties. In addition, although the other evaluation parameters, i.e., the tensile strength and the hexagonal anti-abrasion resistance, are slightly inferior to those of the comparative example, both of them satisfy the respective predetermined levels, i.e., a tensile strength of 25 kN or more and a retention rate after hexagonal bar abrasion of 70% or more. Thus, it is confirmed that the strength and the abrasion resistance of example-7 are also superior relative to the predetermined requirements for seat belt performance.

The webbing of example-8 has a weight reduction rate of 6.90% relative to the comparative example due to the reduction of 16 warp yarns during the forming of the first filament yarn bundle. Thus, it is confirmed that the webbing of example-8 is superior in terms of the lightweight properties. In addition, although the tensile strength is slightly inferior to that of the comparative example, the tensile strength of example-8 satisfies the predetermined level, i.e., a tensile strength of 25 kN or more. Hence, it is confirmed that the strength is also superior relative to the predetermined requirements for seat belt performance. Furthermore, because the retention rate after hexagonal bar abrasion is 83.94%, which is larger than that of the comparative example, it is confirmed that the abrasion resistance of example-8 is superior.

The webbing of example-9 has a weight reduction rate of 3.10% relative to the comparative example due to the reduction in weft density (17 picks per inch) during the forming of the second filament yarn bundle. Thus, it is confirmed that the webbing of example-9 is superior in terms of the lightweight properties. In addition, although the other evaluation parameters, i.e., the tensile strength and the hexagonal anti-abrasion resistance, are slightly inferior to those of the comparative example, both of them satisfy the respective predetermined levels, i.e., a tensile strength of 25 kN or more and a retention rate after hexagonal bar abrasion of 70% or more. Hence, it is confirmed that the strength and the abrasion resistance of example-9 are also superior relative to the predetermined requirements for seat belt performance.

In accordance with the evaluation results shown in FIG. 2, the overall evaluation is represented by "◎" because it is understood that the webbings of example-1 to example-9 may be formed into superior seat belts in terms of all the evaluation parameters, i.e., the lightweight properties, the strength, and the abrasion resistance. On the other hand, the level of the webbing for a seat belt of the comparative example is inferior to a desired level, and hence the overall evaluation is represented by "x" because it is understood that, when the lightweight properties, the strength, and the abrasion resistance are evaluated in an integrated manner and in particular because the weight of the webbing for a seat belt of the comparative example is more than 60 g/m, the lightweight properties thereof are not satisfactory.

As described above, a practical seat belt having superior lightweight properties, strength, and abrasion resistance and a seat belt device formed by using same may be provided.

The webbings for a seat belt of example-1 through example 9 which are formed, for example, by weaving are superior to the webbing of the comparative example in terms of the lightweight properties, the tensile strength, and the retention rate after hexagonal bar abrasion. Thus, the webbings of example-1 through example 9 are effectively used with the weight of a seat belt being reduced while the decrease in strength thereof is suppressed.

In example-1through example-9, because the weft yarns are used in which high shrinking low-melting-point polyester filaments, which are contracted at a thermal shrinkage rate of 30% after being melted under process conditions of 210° C. for 180 seconds or more, are blended with high-melting-point polyester filaments, the cross-section of the single yarn material after the shrinkage of the weft yarns is increased, and thus the rigidity may be increased. Hence, corresponding to the increase in rigidity, the weight reduction may be performed by reducing the number of weft yarns. Accordingly, a webbing for a seat belt may be obtained which has a weight of 60 g/m or less, a tensile strength of 25 kN or more, and a retention rate after hexagonal bar abrasion of 70% or more; and as a result, a seat belt having both rigidity and lightweight properties may be provided. In addition, the thermal shrinkage rate of filaments, i.e., the degree of contraction in the longitudinal direction, may be represented by the following equation: ((length after process—length before process)/length after process)×100, wherein the lengths are obtained before and after the process performed under the above process conditions. By a process method or a measurement method in accordance with, for example, JIS L 1909, the thermal shrinkage rate may be obtained.

The types of filaments for use as the warp yarns and weft yarns, the process conditions and the like may be optionally changed whenever necessary as long as at least a webbing for a seat belt having a weight of 60 g/m or less, a tensile strength of 25 kN or more, and a retention rate after hexagonal bar abrasion of 70% or more is obtained by optionally using high shrinking synthetic filaments having a thermal shrinkage rate (dimensional shrinkage rate) in the range of 20% to 60% under process conditions of 150° C. or more for 180 seconds or more. The weft yarns may be formed by blending the high-melting-point polyester filaments with the low-melting-point polyester filaments (high shrinking yarns). However, for example, the types of high-melting-point filaments and low-melting-point filaments, the combination between the high-melting-point filaments and the low-melting-point filaments, and the blending ratio therebetween may be optionally changed whenever necessary.

In the webbings for a seat belt of example-1 through example-9 which are formed by weaving according to one embodiment, the warp yarns may be formed from a yarn material made of twist yarns or a yarn material made of entangled non-twist yarns. Accordingly, because the entanglement among filaments is increased, and the cohesion is enhanced, the rigidity of the webbing may be further improved. In particular, when the yarn material made of entangled yarns is used, material costs may be reduced as compared to that in the case in which the yarn material made of twist yarns is used. As a result, production costs of the webbing may also be reduced.

In a cross-sectional structure, the warp yarns may be extended to form a curved shape, a so-called "crimping (undulating phenomenon)," in contrast to the weft yarns which are linearly extended. This particular undulating phenomenon is caused by a weaving method forming a woven structure in which weft yarns are woven between warp yarns which are shed alternately. Accordingly, as is the case of the webbings for a seat belt of example-1 through example-9, when the weft density is decreased to 20 picks per inch or less, or when the weft density is further decreased to 18 or 17 picks per inch as is the cases of example-7 and example-9, the degree of meanderings of the curved crimped shape may be decreased, and stress concentrated on curved portions may be alleviated. As a result, the properties may be further improved to simultaneously achieve the increase in rigidity of webbing and the reduction in weight thereof. When the weft density may be optionally set in the range of 20 picks per inch or less, and when the desired webbing properties may be obtained by using high shrinking synthetic filaments, the weft density may be set to more than 20 picks per inch in some cases.

The present invention is not limited to the above exemplary embodiments, and various modifications and changes may be performed. For example, the following may be carried out based on the above embodiments.

In the above exemplary embodiments, the case is described in which, of the warp yarns and the weft yarns, only the weft yarns are formed using high shrinking synthetic filaments. However, only the warp yarns or both the weft yarns and the warp yarns may be formed using high shrinking synthetic filaments.

In the above exemplary embodiments, the case is only described in which, of the warp yarns and the weft yarns, only the warp yarns made of a yarn material which includes entangled non-twist yarns are used. However, only the weft yarns or both the weft yarns and the warp yarns may be formed using a yarn material made of twist yarns or a yarn material made of entangled non-twist yarns. In addition, when the desired webbing properties are obtained by using high shrinking synthetic filaments, the warp yarns and the weft yarns may be formed without using a yarn material made of twist yarns or a yarn material made of entangled non-twist yarns.

In addition, in the above exemplary embodiments, the seat belt device 100 for a driver of an automobile is described; however, the seat belt device may be applied to the structure of a seat belt which restrains a passenger in a front passenger seat or in a rear seat and to the structure of a seat belt used in an airplane or a ship.

The priority application Japanese Patent Application No. 2005-342919, filed Nov. 28, 2005 is incorporated by reference.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A webbing for a passenger restraint belt comprising:

warp yarns and weft yarns made of synthetic filaments and woven so as to extend orthogonally to each other to form the passenger restraint belt, wherein at least one of the warp yarns and the weft yarns are formed using synthetic filaments comprising first filaments and second filaments, wherein the second filaments are provided in the first filaments and have a melting temperature lower than that of the first filaments, wherein the synthetic filaments are high shrinking synthetic filaments which are contracted at a dimensional shrinkage rate of 20% to 60% after the second filaments are melted under conditions of 150° C. or more for 180 seconds or more, and wherein the webbing has a weight of 60g/m or less, a tensile strength of 25 kN or more, and a retention rate after hexagonal bar abrasion of 70% or more.

2. The webbing for a passenger restraint belt according to claim 1, wherein the weft density is 20 picks per inch or less.

3. The webbing for a passenger restraint belt according to claim 1, wherein at least one of the warp yarns and the weft yarns are formed using a filament yarn material made of twist yarns or a filament yarn material made of entangled non-twist yarns.

4. The webbing for a passenger restraint belt according to claim 1, wherein the first filaments are high-melting-point polyester filaments and the second filaments are low-melting-point polyester filaments.

5. The webbing for a passenger restrain belt according to claim 1, wherein the first filaments comprise polyethylene terephthalate.

6. The webbing for a passenger restraint belt according to claim 1, wherein the second filaments comprise polyethylene isophthalate.

7. A seat belt for use as a passenger restraint belt comprising:

a webbing, wherein the webbing comprises warp yarns and weft yarns made of synthetic filaments and woven so as to extend orthogonally to each other to form the seat belt, wherein at least one of the warp yarns and the weft yarns are formed using synthetic filaments composed of first filaments and second filaments, wherein the second filaments are provided in the first filaments and have a melting temperature lower than that of the first filaments, wherein the synthetic filaments are high shrinking synthetic filaments which are contracted at a dimensional shrinkage rate of 20% to 60% after the second filaments are melted under conditions of 150° C. or more for 180 seconds or more, and wherein the webbing has a weight of 60 g/m or less, a tensile strength of 25 kN or more, and a retention rate after hexagonal bar abrasion of 70% or more.

* * * * *